US008258088B2

(12) United States Patent
Bodesheim et al.

(10) Patent No.: US 8,258,088 B2
(45) Date of Patent: Sep. 4, 2012

(54) LUBRICATING GREASE COMPOSITION

(75) Inventors: Günther Bodesheim, München (DE); Martin Schmidt-Amelunxen, Röhrmoos/Arzbach (DE); Dieter Sohn, Greifenberg/Ammersee (DE); Stefan Grundei, Mering (DE); Andrea Höpke, Mainhansen (DE)

(73) Assignee: Klüber Lubrication München KG, München (DE)

( * ) Notice: Subject to any disclaimer, the term of this patent is extended or adjusted under 35 U.S.C. 154(b) by 301 days.

(21) Appl. No.: 12/452,215

(22) PCT Filed: May 20, 2008

(86) PCT No.: PCT/EP2008/004035
§ 371 (c)(1),
(2), (4) Date: Dec. 22, 2009

(87) PCT Pub. No.: WO2008/154997
PCT Pub. Date: Dec. 24, 2008

(65) Prior Publication Data

US 2010/0105586 A1 Apr. 29, 2010

(30) Foreign Application Priority Data

Jun. 20, 2007 (DE) ..... 10 2007 028 425
May 20, 2008 (DE) ..... 10 2008 024 284

(51) Int. Cl.
*C07C 317/22* (2006.01)
*C07D 207/26* (2006.01)
*C10L 1/26* (2006.01)

(52) U.S. Cl. ..... 508/244; 508/268; 508/270

(58) Field of Classification Search ..... 508/244, 508/268, 270
See application file for complete search history.

(56) References Cited

U.S. PATENT DOCUMENTS

2009/0281008 A1 * 11/2009 Fujinami et al. ..... 508/154

FOREIGN PATENT DOCUMENTS

WO WO 2006/109652 A1 * 10/2006

* cited by examiner

*Primary Examiner* — Walter D Griffin
*Assistant Examiner* — Francis C Campanell
(74) *Attorney, Agent, or Firm* — Kubovcik & Kubovcik

(57) ABSTRACT

The invention relates to lubricating grease compositions having a base oil mixture based on oils having viscosities (ISO VG 2 to ISO VG 1500) that are standard for industrial lubricants, an ionic liquid, a thickening agent, e.g., based on a polyurea compound and conventional additives that can be used at current service temperatures that are higher than 120° C. to 260° C., in particular at a service temperature in the region of high service temperatures that are higher than 180° C. to 260° C. and also at low temperatures as low as −60° C. The invention also relates to a method for producing said type of lubricating grease compositions.

11 Claims, No Drawings

LUBRICATING GREASE COMPOSITION

This application is a 371 of international application PCT/EP2008/004035 filed May 20, 2008, which claims priority based on German patent application Nos. 10 2007 028 425.1 and 10 2008 024 284.5 filed Jun. 20, 2007, and May 20, 2008, respectively, and which are incorporated herein by reference.

The invention relates to lubricating grease compositions having a base oil mixture, based on oils having viscosities (ISO VG 2 to ISO VG 1500) that are standard for industrial lubricants, an ionic liquid, a thickening agent, e.g., based on a polyurea compound and conventional additives that can be used at conventional service temperatures of more than 120° C. to 260° C., in particular at a service temperature in the range from more than 180° to 260° C. as well as at low temperatures down to −60° C. The invention also relates to a method for producing such lubricating grease compositions.

The development of novel lubricants must be associated with the general further development of the technology, which makes new and higher demands of the lubricant compositions. These requirements are no longer met by the known lubricant compositions based on mineral oil and/or synthetic oil.

Lubricants are used in automotive engineering, conveyor technology, mechanical engineering, office technology and in industrial plants and machines but also in the fields of household appliances and electronics for entertainment.

Lubricants in roller bearings and friction bearings ensure that a film of lubricant, which transfers loads and separates different parts is established between parts that rub or slide against one another. This achieves the result that metallic surfaces do not come in contact with one another and therefore there is no wear. The lubricants must therefore meet high demands. These includes extreme operating conditions such as very high or very low rotational speeds, high temperatures caused by high rotational speeds or by long-distance heating, very low temperatures, e.g., in bearings that operate in a cold environment or which occur with use in aviation and space travel. Likewise, modern lubricants should be suitable for use under so-called clean room conditions in order to avoid soiling of the room due to abrasion and/or the consumption of lubricants. Furthermore, in use in modern lubricants, evaporation and thus "lackification," i.e., such that they become solidified after a short application and no longer manifests a lubricating effect, should be avoided. Especially high demands are also made of lubricants during use such that the running surfaces of the bearings are not attacked due to slight friction, so that the bearing surfaces run noiselessly and long running times without relubrication are promoted. Lubricants must also withstand the action of forces such as centrifugal force, gravitational force and vibrations.

In addition to the upper service temperature according to DIN 51825, the noise behavior of the lubricant is an important characteristic quantity for a long service lifetime of a grease-lubricated roller bearing in the high temperature range. A lubricating grease may stimulate vibrations in the roller bearing which are in the medium-frequency band from 300 to 1800 Hz and high-frequency band 1800 to 10,000 Hz in revolving participation (rolling over, milling) in comparison with the bearing noise in the low-frequency band at 50 to 300 Hz. Superimposed on the lubricant noise are sound peaks occurring with rollover of hard particles by the roller bearing in the form of shock pulses on the bearing ring. The sound performance is evaluated according to the SKF BeQuiet method based on a static analysis of the noise peaks and the assignment to the noise classes BQ1 to BQ4. With increasing values of the noise class, the noise behavior becomes worse and the lifetime of the roller bearing is shortened (H. Werries, E. Paland, FVA study of the topic "Low-noise lubricating greases," University of Hanover 1994). Thus, 100% noise class BQ1 characterizes a very good noise behavior and low percentage values exclusively in noise class BQ4 characterize very poor noise behavior.

The better the noise behavior of a lubricating grease, the lower are the vibrations of the bearing induced by the lubricant. This is equivalent a low load on the bearing and leads to a longer service lifetime of the bearing.

The use of ionic liquids, hereinafter also referred to as IL (=ionic liquid), in lubrication technology has been investigated extensively in recent years because a broad spectrum of applications could be provided through modification of the cations or anions. Ionic liquids are so-called salt melts which are preferably liquid at room temperature or have melting point<100° C. by definition. Known cation/anion combinations leading to ionic liquids include, for example, dialkylimidazolium, pyridinium, ammonium and phosphonium, etc. with organic anions such as sulfonates, imides, methides, etc., as well as inorganic anions such as halides and phosphates, etc., such that any other combination of cations and anions with which a low melting point can be achieved is also conceivable. Ionic liquids have an extremely low vapor pressure, depending on their chemical structure, are nonflammable and often have thermal stability up to more than 260° C. and furthermore are also suitable as lubricants.

WO 2006/077082 describes a method for sealing rotary shafts using friction seals and the use of ionic liquids as a component of the barrier liquid for face seals for sealing rotating shafts. These barrier fluids should serve to additionally seal rotating shafts. The known barrier liquid are water or oils whose behavior is to be improved with regard to the interaction with the environment of the machine with high demands regarding imperviousness by using ionic liquids.

DE 10 2004 033 021 A1 describes the use of ionic liquids as hydraulic fluids, where the compressibility of liquid pressure transfer media is to be reduced and thus the energy transfer efficiency of hydraulic systems is to be improved.

DE 10 2005 007 100 A1 describes a processing and/or working machine in which an ionic liquid is used as the operating fluid. In the context of use as an operating fluid, this ionic liquid is also used as a liquid lubricant, barrier liquid, sealing liquid, pressure transfer liquid and the like.

The use of liquid lubricants usually requires the use of expensive seals. Lubricating greases themselves have a sealing effect. The use of expensive seals is eliminated, and it is possible to work with simple covers or sealing disks.

The goal of the present invention is to provide a lubricating grease composition which meets the demands mentioned above, in particular being applicable under high and low temperature conditions, having a low vapor pressure or none at all and thus not evaporating during use as well as having a good noise behavior, long running times and producing essentially no wear phenomenon on the roller bearing. Furthermore, the lubricating grease composition should induce a deposition of oil that is suitable for the application.

This goal is achieved according to the invention by a lubricating grease composition consisting of a mixture of a base oil mixture that is based on oils with the standard viscosities (ISO VG 2 to ISO VG 1500) for industrial lubricants, an ionic liquid or a mixture of several ionic liquids, a thickening agent, e.g., based on a polyurea compound as well as conventional additives which may be used at service temperatures of more than 120° C. to 260° C. as well as at low temperatures down to −60° C.

The base oil mixture may be synthetic oil, a mineral oil and/or a native oil. These oils may be used individually or in combination, depending on the application.

The synthetic oils are selected from an ester of an aliphatic or aromatic di-, tri- or tetracarboxylic acid with one or a mixture of $C_7$ to $C_{22}$ alcohols, a polyphenyl ether or alkylated diphenyl ether, an ester of trimethylolpropane, pentaerythritol or dipentaerythritol with aliphatic $C_7$ to $C_{22}$ carboxylic acids, $C_{18}$ dimer acid esters with $C_7$ to $C_{22}$ alcohols, complex esters, individual components or in any mixture. In addition, the synthetic oil may be selected from poly-α-olefins, alkylated naphthalenes, alkylated benzenes, polyglycols, silicone oils, perfluoro polyethers.

The mineral oils may be selected from paraffin-basic, naphthene-basic, aromatic hydrocracking oils; gas to liquid (GTL) liquids, GTL refers to a gas to liquid method and describes a method for production of fuel from natural gas. Natural gas is converted by steam reforming to synthesis gas, which is then converted by Fischer-Tropsch synthesis to fuels by using catalysts. The catalysts and the process conditions control the type of fuel, i.e., whether gasoline, kerosene, diesel or oils are produced. Coal may also be used as a raw material in the same way by the coal to liquid method (CTL) and biomass may be used as a raw material in the biomass to liquid (BTL) method.

Triglycerides from animal/vegetable sources that have been upgraded by known methods such as hydrogenation may be used as native oils. The especially preferred triglyceride oils are genetically modified triglyceride oils with a high oleic acid content. Typical vegetable oils used therein and genetically modified having a high oil content include safflower oil, corn oil, canola oil, sunflower oil, soybean oil, linseed oil, peanut oil, lesquerella oil, meadowfoam oil and palm oil.

As already stated above, the respective desired properties of the lubricant composition are achieved with the ionic liquids through a suitable choice of cations and anions. These desirable properties include an increase in the service life and lubricating effect of the lubricant, adjusting the viscosity to improve the temperature suitability, adjusting the electric conductivity to spread the area of use. Suitable cations for ionic liquids have proven to be a phosphonium cation, an imidazolium cation, a pyridinium cation or a pyrrolidinium cation which may be combined with an anion containing fluorine and selected from bis(trifluoromethylsulfonyl)imide, bis(perfluoroalkylsulfonyl)imide, perfluoroalkyl sulfonate, tris(perfluoroalkyl)methidenes, bis(perfluoroalkyl)imidenes, bis(perfluoroaryl)imides, perfluoroarylperfluoroalkylsulfonylimides and tris(perfluoro-alkyl)trifluorophosphate or with a halogen-free alkyl sulfate anion.

Ionic liquids are especially preferred with highly fluorinated anions because they usually have a high thermal stability. The water uptake ability may be reduced significantly by such anions, e.g., when using bis(trifluoromethylsulfonyl) anion.

Examples of such IL include:

Butylmethylpyrrolidinium-bis(trifluoromethylsulfonyl) imide (MBPimide),

Methylpropylpyrrolidinium bis(trifluoromethylsulfonyl)imide (MPPimide),

1-Hexyl-3-methylimidazolium tris(perfluoroethyl)trifluorophosphate (HMIMPFET),

1-Hexyl-3-methylimidazolium bis(trifluoromethylsulfonyl) imide (HMIMimide),

Hexylmethylpyrrolidinium bis(trifluoromethylsulfonyl) imide (HMP),

Tetrabutylphosphonium tris(perfluoroethyl)trifluorophosphate (BuPPFET),

N-Hexylpyridinium bis(trifluoromethyl)sulfonylimide (Hpyimide),

Butylmethylpyrrolidinium tris(pentafluoroethyl)trifluorophosphate (MBPPFET),

Trihexyl(tetradecyl)phosphonium bis(trifluoromethylsulfonyl)imide (HPDimide),

1-Ethyl-3-methylimidazolium ethyl sulfate (EMIM ethyl sulfate),

1-Ethyl-3-methylimidazolium bis(trifluoromethylsulfonyl) imide (EMIMimide),

1-Ethyl-2,3-dimethylimidazolium bis(trifluoromethylsulfonyl)imide (EMMIMimide),

N-Ethyl-3-methylpyridinium nonafluorobutanesulfonate (EMPyflate)

The thickening agent is either a reaction product of a diisocyanate, preferably 2,4-diisocyanatotoluene, 2,6-diisocyanatotoluene, 4,4'-diisocyanatodiphenylmethane, 2,4'-diisocyanatodiphenylmethane, 4,4'-diisocyanatodiphenyl, 4,4'-diisocyanato-3,3'-dimethyldiphenyl, 4,4'-diisocyanato-3,3'-dimethylphenylmethane which may be used individually or in combination, with an amine of the general formula $R'_2N—R$ or a diamine of the general formula $R'_2N—R—N—R'_2$ where R is an aryl, alkyl or alkylene radical with 2 to 22 carbon atoms and R' is identical to or different from a hydrogen, an alkyl, alkylene or aryl radical, or with mixtures of amines and diamines or is selected from metal soaps, metal sulfonates, metal complex soaps, bentonite, silicate powder, polytetrafluoro-ethylene (PTFE), polyamide, polyimide.

In addition, the inventive lubricating grease compositions contain the usual additives against corrosion, oxidation and for protection against metal influences which are present as chelate compounds, radical scavengers, UV stabilizers, reaction layer forming agents as well as organic or inorganic solid lubricants, e.g., polyimides, polytetrafluoroethylene (PTFE), graphite, metal oxides, boron nitride, molybdenum sulfide and phosphate. Additives are used in particular in the form of compounds containing phosphorus and sulfur, e.g., zinc dialkyl dithiophosphate, boric acid esters as antiwear/extreme pressure additives, aromatic amino, phenols, sulfur compounds as antioxidants, metal salts, esters, nitrogen compounds, heterocyclic compounds as agents to prevent corrosion, glycerol mono- or diesters as friction preventives as well as polyisobutylene, polymethacrylate as viscosity improvers.

The inventive lubricating grease compositions contain 5 to 95 wt % base oil mixture, 1 to 30 wt % ionic liquid, 3 to 50 wt % thickening agent, 0.1 to 10 wt % additives.

With these lubricating grease compositions, the viscosity of the base oil is in the range of 1.98 to 1650 $mm^2/s$ and the viscosity of the ionic liquid is in the range of 1.98 to 1650 $mm^2/s$.

In addition, the lubricating grease compositions have drop points according to DIN ISO 2176 of >180° C. and are suitable for service temperatures to −60° C. according to DIN 51825.

The lubricating grease compositions are suitable for applications for upper service temperatures of more than 120° C. up to 260° C. and for low service temperatures of −60° C. according to DIN 51285. They may also be used at upper service temperatures of more than 180° C. and for low service temperatures down to −60° C. according to DIN 51825.

A lubricant composition having a longer lifetime due to the delay in the increase in viscosity and thus the delay in lackification/hardening of the lubricant due to the almost nonexistent evaporation of the ionic liquid has surprisingly been obtained by a combination of the components listed above. In addition, a lubricating grease composition whose flammability is reduced and which is stable with respect to oxidative and thermal influenced, can be used over a wide range in liquid form, has a negligible vapor pressure and whose viscosity can be adjusted in a suitable manner can be obtained by using ionic liquids.

Since urea greases are frequently used in roller bearings in which high temperatures prevail and long running times are achieved, it is necessary to adjust the greases for such applications because urea greases tend to harden under high temperatures. As a result, roller bearings or ball bearings with inner ring diameters of 100 mm or larger are not adequately supplied with oil. The hardening described here may also result in blockage of the lines that are used for regreasing, so that fresh grease cannot be resupplied or the hardened grease no longer mixes with the fresh grease. It is desirable for urea greases to have a higher oil separation and a lower hardening tendency, so can be used at high temperatures. Such improved products may be used in roller bearings in the corrugated cardboard industry, the wood processing industry and in wheel bearings for commercial vehicles.

However, with metal soap greases, in particular lithium soap greases and lithium complex soap greases, there is a tendency to excessive release of oil at high temperatures so that oil losses occur, limiting the lifetime of the bearing, despite the use of seals.

It has now been discovered that through the addition of ionic liquids, an improvement in the disadvantages described above is achieved.

The following examples show that a lubricating grease composition, which contains the urea as a thickening agent is suitable for use in lubricating roller bearings or ball bearings having inner rings with diameters of at least 100 mm, such that the disadvantages of the known lubricating grease compositions based on urea are avoided.

Such lubricating grease compositions may also be used for relubrication of roller bearings or ball bearings with inner rings with diameters of at least 100 mm.

The compositions listed below have proven to be especially advantageous embodiments of the lubricating grease composition according to the present invention.

Lubricating grease compositions according to claim 1 consisting of 79 wt % poly-α-olefin as the base oil, 17 wt % lithium simple soap as the thickening agent, 4 wt % additive and 1 to 30 wt % butylmethylpyrrolidinium bis(trifluoromethysulfonyl)imide as the ionic liquid have proven suitable.

A lubricating grease composition consisting of 73.5 wt % poly-α-olefin, 4.5 wt % urea thickening agent and 15 wt % lithium complex soap thickening agent, 3 wt % additives and 4 wt % solid lubricants into which 1 to 5 wt % ionic liquids have also been incorporated, where by the ionic liquid is selected from trihexyl(tetradecyl)phosphonium bis(trifluoromethylsulfonyl)imide or N-ethyl-3-methylpyridinium nonafluorobutane sulfonate.

Lubricating grease compositions consisting of 85 wt % ester mixture, 7.5 wt % urea thickening agent, 5 wt % additive mixture and 2.5 to 10 wt % 1-ethyl-3-methyl-imidazolium bis(trifluoromethylsulfonyl)imide are also advantageous in use according to the present invention.

Lubricating grease compositions consisting of 86 wt % synthetic ester, 14 wt % urea thickening agent, 2 wt % additives and 1 to 3 wt % 1-ethyl-3-methylimidazolium ethyl sulfate are also usable according to the invention.

A lubricating grease composition consisting of 74 wt % of a mixture of synthetic esters and poly-α-olefins, 15 wt % urea thickening agent, 9 wt % additives and additionally 1 to 10 wt % butylmethylpyrrolidinium bis(trifluoromethylsulfonyl) imide may also be used.

The inventive lubricating grease compositions are obtained either by mixing base oil thickened with diurea and/or polyurea with the ionic liquid and then homogenizing the mixture via a high-pressure homogenizer and/or three-roll mill or by mixing the base oil with the ionic liquid and thickening the mixture by synthesis or the polyurea or diurea compound in situ and then homogenizing the result via a high pressure homogenizer and/or three-roll mill.

The invention will now be explained in greater detail by the following examples.

EXAMPLES

Unless otherwise indicated in the examples, the percentage amounts are based on wt %. By adding the ionic liquid, the percentage amount of the remaining base oil is reduced accordingly, unless otherwise indicated.

Example 1

To prepare a lubricating grease composition, 77 wt % of a mixture of trimellitic/pyromellitic acid ester as the base oil, 10 wt % MPBimide as the ionic liquid, 8 wt % polyurea and/or diurea as the thickening agent and 5 wt % corrosion preventive, antioxidant and wear preventive as the additives are combined. The ionic liquids are added to the base oil after in-situ synthesis of the thickening agent and are homogenized by high pressure homogenizers, three-roll mills or other suitable methods.

First with the lubricating grease composition obtained in this way, a noise test is performed according to DIN ISO 2137, yielding the results shown in Table 1.

TABLE 1

SKF grease noise test BeQuiet+
BeQuiet + test
Grease class: GN1
0% BQ1, 26% BQ2, 82% BQ3, 99% BQ4

| Resting penetration ¼ cone in $mm^{-1}$ DIN ISO 2137 | Milling penetration 60 DT ¼ cone in $mm^{-1}$ DIN ISO 2137 | Drop point ° C. DIN ISO 2176 | Flow pressure −40° C. DIN 51805 |
|---|---|---|---|
| 64 (264) | 71 (290) | 190° C. | 475 mbar |

| Water stability 3 h 90° C. DIN 51807 part 1 | Oil separation 7 d 40° C. DIN 51817 | Oil separation 30 h 150° C. FTMS 791 C 321 | Loss on evaporation 24 h 150° C. DIN 58397 T1 | Copper corrosion 24 h 150° C. DIN 51811 |
|---|---|---|---|---|
| 0 | 1.95% | 3.2% | 3.8% | 1b |

The upper service temperature was determined according to DIN 51825 on the FAG FE-9 roller bearing testing machine, FAG FE 9 test at 180° C., 6000 rpm, 1500 N, installation A:

L 10=73 h

L 50=222 h

β=1.7

These results show that the inventive lubricating grease compositions not only meet the requirements of the noise test and the DIN standards for roller bearing greases but also far exceed these values.

Example 2

To prepare a lubricating grease composition, 10 or 30 wt % MPBimide as the ionic liquid is additionally added to a grease consisting of 79 wt % of a mixture of poly-α-olefins as the base oil, 17 wt % of a lithium simple soap as the thickening agent, 4 wt % additives. The ionic liquid is added cold to the base oil after in-situ synthesis of the lithium soap grease, stirred in and rolled homogeneously.

TABLE 2

| Sample | Lithium soap grease | Lithium soap grease with 10% IL | Lithium soap grease with 30% IL |
|---|---|---|---|
| Resting penetration in $mm^{-1}$ DIN ISO 2137 | 278 | 274 | 278 |
| Milling penetration 60 DT in $mm^{-1}$ DIN ISO 2137 | 286 | 278 | 298 |
| Drop point ° C. DIN ISO 2176 | 198 | 197 | 199 |
| Water stability 3 h at 90° C. | 1 | 2 | 1 |
| Oil separation 24 h at 150° C. FTMS 791 C 321 | 6.09% | 3.62% | 2.45% |
| Loss on evaporation 24 h at 150° C. | 3.98% | 4.15% | 3.42% |

Table 2 shows the definite reduction in oil separation due to the addition of the ionic liquid while retaining the other tested parameters.

The separated oil (FTMS standard) was identified as the base oil, i.e., no ionic liquid was separated.

According to the basic recipe described above for a lithium soap grease according to Example 2, additional experiments were conducted with smaller amounts of ionic liquid, yielding the results shown in Table 3.

TABLE 3

| Sample | Standard recipe | With 5% MBPimide | With 2% MBPimide | With 1% MBPimide |
|---|---|---|---|---|
| Resting penetration in $mm^{-1}$ DIN ISO 2137 | 278 | 264 | 264 | 274 |
| Milling penetration 60 DT in $mm^{-1}$ DIN ISO 2137 | 286 | 274 | 268 | 274 |
| Oil separation 30 h at 150° C. FTMS 791 C 321 | 10.1% | 4.4% | 4.6% | 4.9% |
| Loss on evaporation 24 h at 150° C. DIN 58397 part 1 | 3.98% | 4.7% | 4% | 3.5% |

Even when using 1 to 5 wt % ionic liquid, reduced oil separation was also observed even when the test time was prolonged to 30 hours.

Example 3

In this example, a standard grease is prepared on the basis of a roller bearing grease, consisting of a synthetic hydrocarbon, a synthetic ester, an aromatic diisocyanate, aliphatic monoamines; 10% MBPimide is added to this standard grease and tested in an ROF roller bearing grease testing machine. This test determines the lifetime of the lubricating grease composition tested and determines the upper service temperatures of lubricating greases in roller bearings at high rotational speed and standard low axial and radial loads. A grooved ball bearing 6204-2Z-C3/VM104, which was exposed to a load of 100 N in the axial load and 200 N in the radial load, a rotation speed of 18,000 $min^{-1}$, a temperature of 160° C. and loaded with a filling quantity of 1.5 $cm^3$ was used as the test bearing. It was found that the lubricating grease composition without IL had an $L_{50}$ value of 186 hours, and the lubricating grease composition with IL had an $L_{50}$ value of 717 hours. This shows the definite improvement in the lifetime of a lubricating grease composition with ionic liquid.

Example 4

In this example the VKA welding force is determined according to DIN 51350. To do so, a roller bearing grease consisting of a synthetic ester, perfluoro polyether (PFPE), aromatic diisocyanate and the mixture of aliphatic and aromatic amines is used. The following lubricating grease compositions were then subjected to the VKA welding force test.

Lubricating grease compositions which are greases of NLGI 2-3:

Grease 1: standard with perfluoro polyether

Grease 2: standard without perfluoro polyether with 2.5% EMIMimide

Grease 3: standard without perfluoro polyether with 5% EMIMimide

Grease 4: standard without perfluoro polyether with 7.5% EMIMimide

Grease 5: standard without perfluoro polyether with 10% EMIMimide

TABLE 4

| Lubricating grease | VKA good force/welding force/cup diameter |
|---|---|
| Grease 1 | 1600 N/1800 N/2.6 mm |
| Grease 2 | 1500 N/1600 N/2.5 mm |
| Grease 3 | 2400 N/2600 N/3.2 mm |
| Grease 4 | 3600 N/3800/3.5 mm |
| Grease 5 | 4400 N/4600 N/4.0 mm |

The comparison of the VKA values shows that with the addition of more than 2.5% ionic liquid, a better VKA value is achieved.

TABLE 5

| Lubricating grease | BeQuiet+ | VKA good force/welding force/cup diameter |
|---|---|---|
| Grease 1 | GN4 | 1600 N/1800 N/2.6 mm |
| Grease 5 | GN4 | 4400 N/4600 N/4.0 mm |

In addition a better VKA value is also obtained with equally good noise values when 10% ionic liquid is added.

The greases were also subjected to an FE 9 roller bearing grease test in which the lifetime of the greases tested was determined and the upper service temperature of lubricating greases in roller bearings at average rotational speeds and average axial loads was determined. A FAG special bearing 529689H 109 (corresponding to a beveled ball bearing 7206 B with a steel cage) was used as the bearing, with a JP2 cage at a rotational speed of 6000 $min^{-1}$ an axial load of 1500 N, a temperature of 200° C. and a filling quantity of 2 $cm^3$. The lubricating grease is tested and the results of the L10 and L50 values are shown in Table 6.

TABLE 6

| Lubricating grease | Grease concept | FE 9 200° C. |
|---|---|---|
| Grease 1 | Standard with polyfluoro polyether | $L_{10}$: 10 h<br>$L_{50}$: 13 h |
| Grease 3 | Standard without PFPE + 5% EMIMimide | $L_{10}$: 8 h<br>$L_{50}$: 25 h |
| Grease 5 | Standard without PFPE + 10% EMIMimide | $L_{10}$: 63 h<br>$L_{50}$: 80 h |
| Grease 6 | Standard without PFPE + 10% MBPimide | $L_{10}$: 45 h<br>$L_{50}$: 55 h |
| Grease 7 | Standard without PFPE + 10% EMMIMimide | $L_{10}$: 16 h<br>$L_{50}$: 72 h |

This table shows that by due to the addition of ionic liquids, the greases have a longer service lifetime, as found by comparing the values determined for grease 1 with those obtained using perfluoro polyether without ionic liquids.

Another lubricating grease composition was subjected to a FAG FE 9 test after adding 10% HDPimide to this grease without PFPE (grease 8). The following service times were obtained $L_{10}$: 66 h, $L_{50}$: 101 h and β; 4.4. These results show that the inventive lubricating grease compositions meet the requirements for roller bearing greases according to DIN standards for a service temperature up to 200° C.

Example 5

In this example the VKA welding test according to DIN 51350 was determined. To do so a roller bearing grease consisting of synthetic ester, aromatic diisocyanate and aliphatic amines was used as the standard composition. The following lubricating grease compositions were then subjected to the VKA welding force test.

Lubricating grease compositions which are greases of NLGI 2-3:

Grease 1: standard without IL

Grease 2: standard with the addition of 5% EMIMimide (oil substitute)

Grease 3: standard with the addition of 10% EMIMimide (oil substitute)

TABLE 7

| Lubricating grease | VKA<br>good force/welding force/cup diameter |
|---|---|
| Grease 1 | <1200 N |
| Grease 2 | 1400 N/1600 N/2.5 mm |
| Grease 3 | 3800 N/4000 N/3.5 mm |

Table 7 shows that the welding force is improved and better VKA values are obtained with the use of IL in the grease.

TABLE 8

| Lubricating grease | BeQuiet+ | VKA<br>good force/welding force/cup diameter |
|---|---|---|
| Grease 1 | GN4 | <1200 N |
| Grease 3 | GN4 | 3800 N/4000 N/3.5 mm |

Better VKA value with equally good noise value (use 10% IL):

Furthermore, the question of whether the hardening of fats under thermal stress could be prevented by adding ionic liquids was investigated.

At a thermal burden of 160° C., a so-called "aluminum dish test" was used. To do, first the viscosity of the grease which had not yet been loaded was measured. In an aluminum dish with a diameter of approximately 50 mm, height approximately 15 mm, the grease to be tested was spread as homogeneously and smoothly as possible up to ¾ of the height of the dish. Next the dish was closed with a fitting cover. The sealed dish was then placed on a furnace plate and stressed at an elevated temperature in a furnace. The viscosity of the grease was measured in a weakly rhythm.

The apparent dynamic viscosity was measured at 300 $s^{-1}$ at 25° C.

The following lubricating grease compositions were subjected to this test.

Grease 1: standard recipe without IL

Grease 5: addition of 1% EMIM ethyl sulfate

Grease 6: addition of 3% EMIM ethyl sulfate

Grease 7: addition of 5% EMIM ethyl sulfate

TABLE 9

| | fresh | 1 week | 2 weeks | 3 weeks |
|---|---|---|---|---|
| Grease 1 | 2794 | 5545 | 4548 | 4650 |
| Grease 5 | 3312 | 2000 | 1842 | 1425 |
| Grease 6 | 3320 | not measurable | — | — |
| Grease 7 | 3348 | not measurable | — | — |

The values of the apparent dynamic viscosity are given in mPas.

The grease becomes softer with the addition of 1% EMIM ethyl sulfate; with 3% the grease is very inhomogeneous (not measurable) and with 5% it has "totally fallen apart" (not measurable).

It is clearly apparent that by adding 1% EMIM ethyl sulfate, the material remains softer under thermal stress. With the addition of more than 1% IL, no improvement in temperature stressing can be detected.

Example 6

In this example, the improvement in wheel bearing greases by adding ionic liquids is investigated. In particular, wheel bearing greases for trucks are subjected to high thermal demands as well as high demands with respect to load. An especially high thermal load occurs when the vehicles must be braked constantly in descending on a mountain pass road, for example. For simulation of this stress, FE 8 roller bearing tests are performed, characterized by a periodic temperature change.

A composition consisting of a poly-α-olefin, an aromatic diisocyanate, a mixture of aliphatic and aromatic amines and a lithium complex soap (standard) was used as the basic lubricating grease for these tests.

The following lubricating grease compositions were used:

Grease 1: standard recipe
Grease 2: standard plus 5% HDPimide

These lubricating grease compositions were subjected to the following tests shown in Table 10.

TABLE 10

| Lubricating grease | Resting penetration in $mm^{-1}$ | Milling penetration 60 DT in $mm^{-1}$ | Water stability | Flow pressure in mbar |
|---|---|---|---|---|
| Grease 1 | 223 | 226 | 0 | 1125 |
| Grease 2 | 223 | 223 | 0 | 1075 |

| Lubricating grease | Oil separation 7 d 40° C. | Oil separation 30 h 150° C. |
|---|---|---|
| Grease 1 | 0.54% | 2.85% |
| Grease 2 | 0.57% | 5.42% |

The grease to which 5% HDPimide was added showed a greater separation of oil.

To investigate hardening, the covered aluminum dish test described above was used.

The viscosity measurements were performed at 160° C., with the values given in mPas.

TABLE 11

| | fresh | 5 days | 12 days | 19 days | 25 days | 35 days |
|---|---|---|---|---|---|---|
| Grease 1 | 9956 | 8014 | 8619 | 8771 | 10,276 | 12,243 |
| Grease 2 | 9395 | 7522 | 5492 | 5717 | 8817 | 8508 |

For all samples, the apparent viscosity can be measured. The standard grease appears to be drier than the grease containing IL.

The sample with IL shows a drop in viscosity and is softer than the sample without IL, which becomes harder.

This leads to a longer running time, e.g., in the FE 8 roller bearing test. In these tests, the friction moment and temperature gradient in a bearing as well as the wear on the roller bearing components are determined according to DIN 51819. The periodically changing temperature changes between 130° C., which corresponds to normal operation, and 170° C., which corresponds to driving down a mountain pass.

In the case of the composition labeled as grease 1 without IL, there is high wear and a short running time of 215 hours. Even in a second heating phase of 170° C., the test run had to be terminated because the material was generating so much inherent heat that the fan had to be turned on.

The test with the lubricating grease composition designated as grease 2 plus 5% HDPimide had less wear and a longer running time of 377 hours; five cycles were carried out at a temperature of 170° C. The test machine was intentionally shut down but further operation would have been possible. The material led to only a slight inherent heating and extra heating was required.

Additional tests were conducted with the following lubricating grease compositions. The results are shown in Tables 12 and 13.

Grease 1: standard recipe (Example 6) without IL
Grease 3: standard plus 1% HDPimide
Grease 4: standard plus 2% HDPimide
Grease 5: standard plus 3% HDPimide
Grease 6: standard plus 1% N-ethyl-3-methylpyridinium nonafluorobutanesulfonate
Grease 7: standard plus 2% N-ethyl-3-methylpyridinium nonafluorobutanesulfonate
Grease 8: standard plus 3% N-ethyl-3-methylpyridinium nonafluorobutanesulfonate

TABLE 12

| Lubricating grease | Resting penetration in $mm^{-1}$ | Milling penetration 60 DT in $mm^{-1}$ | Loss on evaporation 24 h 150° C. | Oil separation 30 h 150° C. |
|---|---|---|---|---|
| Grease 1 | 223 | 226 | 2.2% | 2.85% |
| Grease 3 | 234 | 238 | 2.67% | 3.5% |
| Grease 4 | 219 | 219 | 2.44% | 3.94% |
| Grease 5 | 204 | 219 | 2.14% | 4.59% |
| Grease 6 | 208 | 211 | 3.26% | 8.35% |
| Grease 7 | 204 | 215 | 3.4% | 10.03% |
| Grease 8 | 211 | 208 | 3.18% | 9.6% |

The samples with IL have increased oil separation. The extent of oil separation can thus be adjusted through the type and quantity of ionic liquid used.

TABLE 13

| Viscosity measurements, loading at 160° C.; values are given in mPas: | | | | |
|---|---|---|---|---|
| | fresh | 1 week | 2 weeks | 3 weeks |
| Grease 1 | 9956 | 7379 | 8561 | 14,920 |
| Grease 3 | 9468 | 6974 | 4532 | 7276 |
| Grease 4 | 9477 | 6283 | 5768 | 6991 |
| Grease 5 | 9424 | 6784 | 4294 | 6240 |
| Grease 6 | 10,206 | 6852 | 5304 | 7109 |
| Grease 7 | 9784 | 6832 | 6588 | 7566 |
| Grease 8 | 9637 | 6601 | 6734 | 7639 |

This example shows that the performance of a radial bearing grease for trucks can be significantly increased through ionic liquids.

The above examples show the advantageous effect of adding ionic liquids to oils based on industrial lubricants.

The invention claimed is:

1. A lubricating grease composition consisting of a mixture of (a) 5 to 95 wt % base oil based on oils with a standard viscosity for industrial lubricants, consisting of an ester of an aromatic or aliphatic di-, tri- or tetracarboxylic acid with one or a mixture of $C_7$ to $C_{22}$ alcohols consisting of a polyphenyl ether or alkylated diphenyl ether, an ester of trimethylolpropane, pentaerythritol or dipentaerythritol with aliphatic $C_7$ to $C_{22}$ carboxylic acids, $C_{18}$ dimer acid esters with $C_7$ to $C_{22}$ alcohols, complex esters as individual components or in any mixture, or selected from poly-α-olefins, alkylated naphthalenes, alkylated benzenes, polyglycols, silicone oils, perfluoro polyethers, (b) 1 to 10 wt % ionic liquid or a mixture of ionic liquids selected from the group consisting of butylmethylpyrrolidinium bis(trifluoromethylsulfonyl) imide, trihexyl(tetradecyl)phosphonium bis(trifluoromethylsulfonyl)imide, 1-ethyl-3-methylimidazolium ethyl sulfate, 1-ethyl-3-methylimidazolium bis(trifluoromethylsulfonyl)imide and N-ethyl-3-methylpyridinium nonafluorobutanesulfonate, (c) 3 to 50 wt % thickening agent selected from the group consisting of a reaction product of a diisocyanate selected from the group consisting of 2,4-diisocyanatotoluene, 2,6-diisocyanatotoluene, and 4,4'-diisocyanatodiphenylmethane, which may be used individually or in combination, with an amine of the general formula $R'_2N—R$, where R is an aryl, alkyl or alkylene radical with 2 to 22 carbon atoms and R' is identical or different hydrogen, an alkyl, alkylene or aryl radical, metal soaps and metal complex soaps, and (d) 0.1 to 10 wt % conventional additives individually or in combination, selected from the group consisting of corrosion preventives, oxidation preventives, wear preventives, friction reducing agents, agents to protect against metal effects, UV stabilizers, organic or inorganic solid lubricants selected from polyimide, polytetrafluoroethylene (PTFE), graphite, metal oxides, boron nitride, molybdenum sulfide and phosphate.

2. The lubricating grease composition according to claim 1, consisting of 79 wt % poly-α-olefin as the base oil, 17 wt % lithium simple soap as thickening agent, 4 wt % additives and additionally 1 to 10 wt % butylmethylpyrrolidinium bis(trifluoromethylsulfonyl)imide as the ionic liquid.

3. The lubricating grease composition according to claim 1, consisting of 73.5 wt % poly-α-olefin, 4.5 wt % urea thickening agent, 15 wt % lithium complex soap thickening agent, 3 wt % additive, 4 wt % solid lubricants and 1 to wt % ionic liquids, whereby the ionic liquid is trihexyl(tetradecyl) phosphonium-bis(trifluoromethylsulfonyl)imide or N-ethyl-3-methylpyridinium nonafluoro-butane sulfonate.

4. The lubricating grease composition according to claim 1, consisting of 85 wt % ester mixture, 7.5 wt % urea thickening agent, 5 wt % additives and 2.5 to 10 wt % 1-ethyl-3-methylimidazolium bis(trifluoromethylsulfonyl)imide.

5. The lubricating grease composition according to claim 1, consisting of 84 wt % synthetic ester, 14 wt % urea thickening agent, 2 wt % additives and 1 to 3 wt % 1-ethyl-3-methylimidazolium ethyl sulfate.

6. The lubricating grease composition according to claim 1, consisting of 76 wt % of a mixture of synthetic esters and poly-α-olefins, 15 wt % urea thickening agent, 9 wt % additives and additionally 1 to 10 wt % butylmethylpyrrolidinium bis(trifluoro-methylsulfonyl)imide.

7. The lubricating grease composition according to claim 1 in which the viscosity of the base oil is in the range of 1.98 to 1650 $mm^2/s$ and the viscosity of the ionic liquid is in the range of 1.98 to 1650 $mm^2/s$.

8. The lubricating grease composition according to claim 1, in which the drop points according to DIN ISO 2176 are higher than ≧180° C. and are suitable for service temperatures down to −60° C. according to DIN 51825.

9. The lubricating grease composition according to claim 1, having an upper service temperatures of more than 120° C. up to 260° C. and a low service temperatures down to −60° C. according to DIN 51825.

10. The lubricating grease composition according to claim 1, having an upper service temperatures of more than 180° C. up to 260° C. and a low service temperatures down to −60° C. according to DIN 51825.

11. The A combination of the lubricating grease composition according to claim 1, containing urea as thickening agent, and roller bearings or ball bearings with inner rings having diameters of at least 100 mm.

* * * * *